US008800123B2

(12) United States Patent
Stündl

(10) Patent No.: US 8,800,123 B2
(45) Date of Patent: Aug. 12, 2014

(54) DEVICE AND METHOD FOR PRODUCING INTERWEAVING KNOTS

(71) Applicant: Oerlikon Textile GmbH & Co. KG, Remscheid (DE)

(72) Inventor: Mathias Stündl, Wedel (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 0 days.

(21) Appl. No.: 13/893,835

(22) Filed: May 14, 2013

(65) Prior Publication Data

US 2013/0247341 A1 Sep. 26, 2013

Related U.S. Application Data

(63) Continuation-in-part of application No. PCT/EP2011/066537, filed on Sep. 22, 2011.

(30) Foreign Application Priority Data

Nov. 30, 2010 (DE) ..... 10 2010 052 961

(51) Int. Cl.
*D02J 1/08* (2006.01)
*D02G 1/16* (2006.01)
*D02J 1/06* (2006.01)

(52) U.S. Cl.
CPC . *D02J 1/08* (2013.01); *D02G 1/161* (2013.01); *D02J 1/06* (2013.01)
USPC ..... 28/271; 28/252

(58) Field of Classification Search
CPC ..... D02J 1/08; D02J 1/06; D06G 1/161; D06G 1/162
USPC ..... 28/271, 272, 274, 276, 219, 220, 243, 28/246, 247, 252, 253, 254, 258; 264/210.8, 290.5, 290.7; 57/293, 289, 57/350, 908
See application file for complete search history.

(56) References Cited

U.S. PATENT DOCUMENTS 2,874,445 A * 2/1959 Griset, Jr. ..... 28/248
2,985,995 A * 5/1961 Bunting, Jr. et al. ..... 57/204
3,217,386 A * 11/1965 Clendening, Jr. ..... 68/3 R
(Continued)

FOREIGN PATENT DOCUMENTS

DE 37 27 263 2/1989
DE 41 40 469 6/1993
(Continued)

OTHER PUBLICATIONS

PCT/EP2011/066537 International Search Report dated Nov. 16, 2011 (4 pages including 2 page English translation).

*Primary Examiner* — Amy Vanatta
(74) *Attorney, Agent, or Firm* — Brinks Gilson & Lione; G. Peter Nichols

(57) ABSTRACT

A device and a method for producing interweaving knots in a multifilament thread are described. The thread is guided in a circumferential guiding groove of a rotating annular nozzle in contact with the groove base of the guiding ring. An inlet thread guide and an outlet thread guide are arranged such that the contact wrap angle of the thread in the guiding groove of the annular nozzle is greater than the opening angle of the chamber opening on the stator. Thus, the thread is guided with contact before the pressure impulse is generated and the annular nozzle is preferably driven with a circumferential speed that is lower than the speed of the thread in order to influence the thread tension.

15 Claims, 5 Drawing Sheets

(56) References Cited

U.S. PATENT DOCUMENTS

| | | | | | |
|---|---|---|---|---|---|
| 4,058,960 | A | * | 11/1977 | Movshovich et al. | 57/293 |
| 4,612,874 | A | * | 9/1986 | Mitter | 118/410 |
| 5,134,840 | A | * | 8/1992 | Niederer et al. | 57/204 |
| 5,390,400 | A | * | 2/1995 | Jacob et al. | 28/274 |
| 6,120,715 | A | * | 9/2000 | Weigend | 264/103 |
| 2002/0043162 | A1 | * | 4/2002 | Laird et al. | 101/116 |
| 2008/0083103 | A1 | * | 4/2008 | Germer | 28/221 |

FOREIGN PATENT DOCUMENTS

| | | | | |
|---|---|---|---|---|
| DE | 19501309 | A1 | * | 8/1995 |
| GB | 2321651 | A | * | 8/1998 |

* cited by examiner

DEVICE AND METHOD FOR PRODUCING INTERWEAVING KNOTS

This application is a continuation-in-part of and claims the benefit of priority from PCT application PCT/EP2011/066537 filed Sep. 22, 2011; and German Patent Application DE 10 2010 052 961.3 filed Nov. 30, 2010; the disclosure of each is hereby incorporated by reference in its entirety.

BACKGROUND

The invention relates to concerns a device for producing interweaving knots in a multi-filament thread as well as to a method for producing interweaving knots with such a device.

DE 41 40 469 A1 discloses a generic device for producing interweaving knots, as well as a generic method for producing interweaving knots in a multi-filament thread.

For the production of multi-filament threads, it is generally known that the individual filament strands in a thread are held together by so-called interweaving knots. Such interweaving knots are produced by treating the thread with compressed air. Depending on the type of thread and the process, the number of interweaving knots needed for each unit of length and the stability of the interweaving knots could be subject to different requirements. High knot stability and a high number of interweaving knots are needed for each unit of length in the thread especially in the production of carpet yarns, which are used immediately following a melt spinning process for further processing.

In order to achieve a relatively high number of interweaving knots when working with higher speeds of the thread, the generic device includes a rotating annular nozzle that interacts with a stationary stator. The annular nozzle includes a circumferential thread guiding groove, and at the base of said thread guiding groove, several radially aligned nozzle bores are evenly distributed about the circumference. The nozzle bores penetrate the annular nozzle from the guiding groove to an internal centering diameter, which is guided on the circumference of the stator. The stator comprises an internal pressure chamber which has a chamber opening that is connected to the circumference of the stator. The chamber opening on the stator, as well as the nozzle bores in the annular nozzle are located in a plane. As a result, the nozzle bores are fed one after another to the chamber opening when the annular nozzle is rotating. The pressure chamber is connected with a compressed air source to produce a pressure impulse in the thread guiding groove of the annular nozzle during the interaction of the nozzle bores and the pressure chamber opening. Opposite of the area of the mouth of the pressure chamber opening, a cover is provided at the annular nozzle which allows the yarn to be guided in a closed guiding groove. The inlet and outlet are formed, respectively, by an inlet thread guide and an outlet thread guide. For this purpose, the inlet thread guide and the outlet thread guide are arranged on the annular nozzle.

In the well-known device, the annular nozzle includes a plurality of nozzle bores evenly distributed about the circumference, thus producing a relatively high number of interweaving knots. However, it became apparent that the interweaving knots produced had relatively large dimensions and comparatively no stability. Such weakly developed interweaving knots are completely unsuitable especially for yarns that are immediately used for further processing.

SUMMARY

Therefore, the invention has the objective of further developing the generic device for producing interweaving knots, as well as the generic method for producing interweaving knots in such a way that the yarn is provided with intense and strongly developed interweaving knots.

Furthermore, the invention has the objective of providing a device and a method of the above-mentioned type which offers high flexibility in number and development of the interweaving knots produced.

According to the invention, this problem is solved by providing a device in which the inlet thread guide and the outlet thread guide are arranged in such a way that the contact wrap angle of the thread in the guiding groove of the annular nozzle is greater than an opening angle of the chamber opening on the stator.

The invention is based on the knowledge that upon a first air intake in the annular nozzle the thread is guided with contact in the guiding groove. As a result, the thread is kept directly above the mouth of the nozzle bore. The contact of the thread in the nozzle groove limits the thread in its movement. This results in intense knot formation.

Moreover, a small opening angle of the chamber opening on the stator has the advantage that it is possible to generate short opening periods at the nozzle bores, resulting in short and distinct pressure impulses. In this way, it is also possible to reduce air consumption or prevent increased leakage losses of compressed air.

To maintain good contact of the thread in the guiding groove, the device according to the present invention is preferably designed in such a way that the contact wrap angle of the thread in the guiding groove of the annular nozzle is greater by a factor of 1.2, preferably at least by a factor of 1.5 than the opening angle of the chamber opening on the stator. As a result, the thread can be inserted in the guiding groove in a defined manner before and after air pressurization.

Preferably, the inlet thread guide and the outlet thread guide are arranged mirror-symmetrically to the annular nozzle, wherein the chamber opening on the stator can be designed symmetrically or asymmetrically to a mirror-symmetrical axis. In a symmetrical arrangement of the chamber opening the same inlet characteristics and outlet characteristics of the thread are realized on both sides. However, for the formation of the interweaving knots it can also be advantageous when, in relation to the outlet, the inlet of the thread is provided with a longer contact wrap section. The knot formation can be influenced also by reversing the length ratio. In this instance, the chamber opening on the stator would be designed asymmetrically to the mirror-symmetrical axis between the thread guides.

The thread tension on the running thread is also of great importance when producing interweaving knots. Therefore, independent of the respective speed of the thread and independent of the respective speed of the annular nozzle, the inlet thread guide and the outlet thread guide are configured in such a way that the contact wrap angle of the guiding groove ranges between 12° and 180°. Thus, depending on the state of stress of the thread, it is possible to select different contact wrap angles. Consequently, even intense interweaving knots can be produced on threads that are guided with lower thread tension. In this instance, the thread is retained in the guiding groove of the annular nozzle with a relatively large contact wrap angle. The relatively small contact wrap angles in the guiding grooves are preferably used for threads that are guided with relatively high thread tensions.

Another embodiment of the device of the present invention may be used to generate a specific pressure impulse above the nozzle bore in the annular nozzle, depending on the selection of the contact wrap angle in the guiding groove. In the device, the chamber opening on the stator is designed in such a way that the opening angle of the chamber opening ranges between 10° and 40°. Greater opening angles of the chamber opening are avoided in order to prevent high consumption and loss of air.

For the regularity of knot formation, especially with small contact wrap angles, it became apparent that the space between the inlet thread guide and the annular nozzle can have a positive effect. In this respect, it is suggested to form a space that generates a length of the inlet section in a range of between 2 cm and 15 cm for the formation of a non-contact inlet section of the thread between the inlet thread guide and the annular nozzle.

Correspondingly, there is also a space between the outlet thread guide and the annular nozzle producing a length of the outlet section in a range of between 2 cm and 15 cm in order to create a non-contact outlet section of the thread between the outlet thread guide and the annular nozzle.

According to another embodiment the present invention, the number of interweaving knots generated for each unit of length in the thread can be advantageously increased by designing several nozzle bores on the annular nozzle. For this purpose, an angular pitch formed between two adjacent nozzle bores is always greater than the opening angle of the chamber opening on the stator. As a result, it can be guaranteed that each nozzle bore generates a basically consistent pressure impulse.

The intensity of the pressure impulses and thus the pressurized air treatment of the thread can be improved when the nozzle bores of the annular nozzle have length to diameter proportions in the range of between 0.5 and 5. Thus, it is possible to avoid in an advantageous manner energy losses based on flow resistances when generating the pressure impulses.

According to some embodiments of the present invention, the annular nozzle can be powered via the incoming thread. In particular, several guiding grooves arranged in parallel are designed on the annular nozzle for guiding several threads. However, to be able to specifically set a relative speed between the thread and the annular nozzle, the annular nozzle may be designed to be powered and coupled with a motor such as an electric motor. As a result, the annular nozzle can be driven faster or slower in relation to the speed of the thread.

Preferably, the inlet thread guide and outlet thread guide attached to the powered annular nozzle are formed by freely rotating guide rollers. In order to obtain specific thread tensions for the inlet or outlet of the thread, the inlet thread guide or the outlet thread guide is formed by a powered godet. Thus, by setting a speed difference between the annular nozzle and the godet, it is possible to generate additional effects for the knot formation.

The friction of the thread generated with a relative speed between the annular nozzle and the thread has had an especially positive effect on the strength and length of the knot. In this respect, the method of the present invention is of special advantage for treating a thread guided between two godets with the device of the present invention. To this end, the annular nozzle is powered with a circumferential speed that is lower than the speed of the thread. The annular nozzle and the thread are guided in the same direction so that in addition to the frictional contact, a sliding friction occurs to the thread, which has a positive effect on the pressurized air treatment.

In particular, the present method has proved to be especially advantageous for swirling so-called BCF yarns. To this end, the circumferential speed of the annular nozzle has been set smaller than the speed of the thread by a factor in the range between 0.35 and 0.80. When using factors greater than 0.8, the knot strength of the interweaving knots in the thread decreased. Using factors less than 0.35 resulted in an uneven distribution of knots showing weaker characteristics on the thread. In this respect, the circumferential speed of the annular nozzle of the invention-based device should be smaller than the speed of the thread by a factor in the range between 0.35 and 0.8 in order to be able to utilize the advantageous effect dynamic friction has on the formation of interweaving knots.

The device and the method of the present invention are especially suitable for producing on multi-filament threads a high number of strong and characteristic interweaving knots when using speeds of the thread above 3000 m/min. The device and method of the present invention are described in more detail with reference to the following figures.

DETAILED DESCRIPTION

Figure 1:
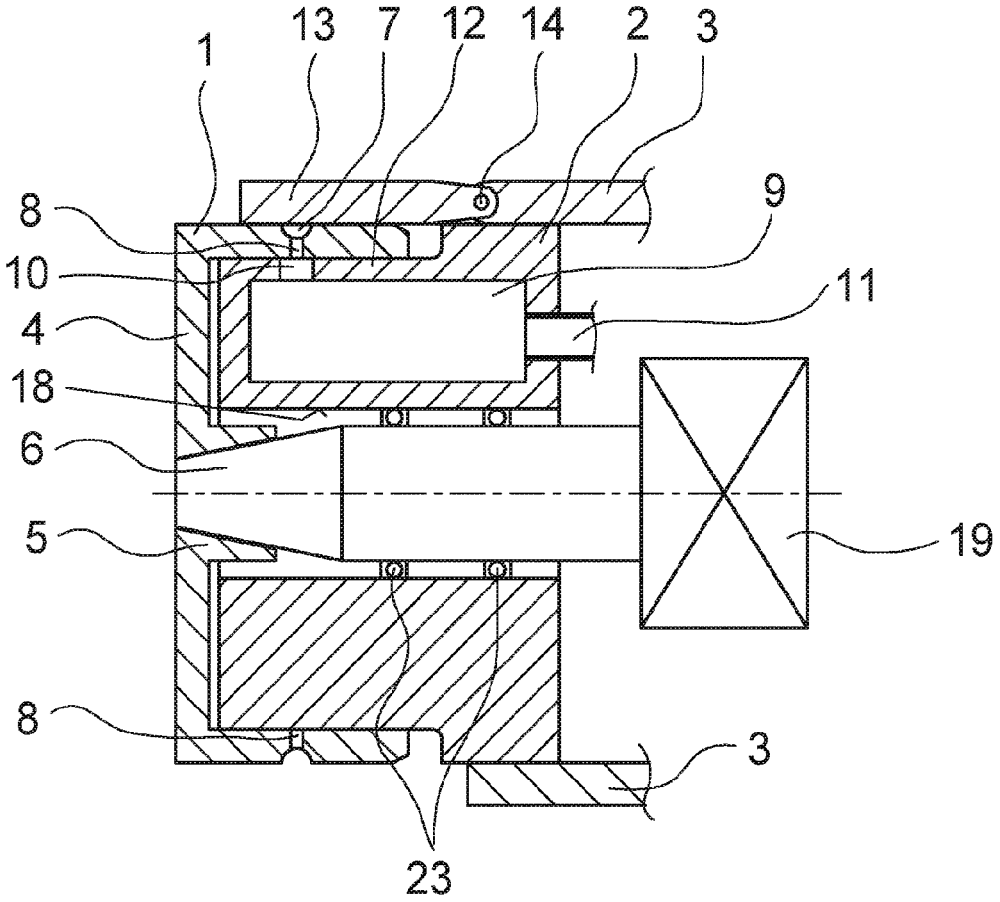
FIG. 1 is a diagram of a longitudinal view of one embodiment of the device according to the present invention.
Figure 2:
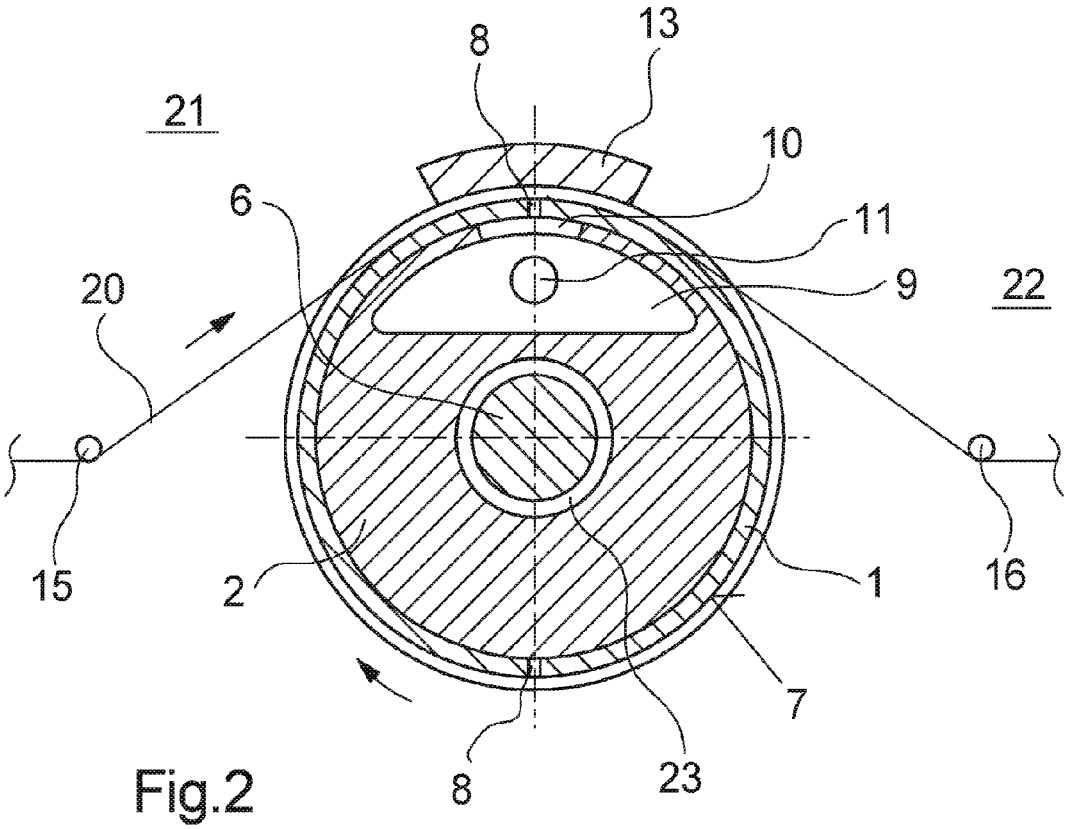
FIG. 2 is a cross-sectional view of the embodiment shown in FIG. 1.

FIGS. 1 and 2 show several views of a first embodiment of the device according to the present invention. FIG. 1 shows a longitudinal view of the embodiment, and FIG. 2 shows a cross-section of the embodiment. If no specific reference is made to one of the figures, the subsequent description applies to both figures.

The device for producing interweaving knots in a multi-filament thread comprises a rotating annular nozzle 1, which has a cup-shaped design and which is connected with a drive shaft 6 by means of an end wall 4 and a hub 5. The hub 5 is attached at a free end of the drive shaft 6.

With its centering diameter, the annular nozzle 1 is guided in the form of sheathing on a guiding collar 12 of a stator 2. On its circumference, the annular nozzle 1 comprises a circumferential guiding groove 7, and at the base of said guiding groove 7 is a nozzle bore 8, which completely penetrates the annular nozzle 1 to an internal centering diameter. In this embodiment, the annular nozzle 1 comprises two nozzle bores 8 which are aligned offset to one another by 180° and which open to the base of the guiding groove 7. In principle, the number of nozzle bores 8 provided in the annular nozzle 1 may be dictated by the operating parameters. Whether one or several nozzle bores are included in the annular nozzle 1 depends on the respective process and type of thread, because the number of nozzle bores 8 is basically proportional to the number of interweaving knots produced in each unit of length in a thread.

At a specific position on the circumference of the guiding collar 12, the stator 2 comprises a chamber opening 10, which is connected with a pressure chamber 9 located in the interior of the stator 2. The pressure chamber 9 is connected with a compressed air source (not shown) via a compressed air supply 11. The chamber opening 11 on the guiding collar 12 and the nozzle bores 8 in the annular nozzle 1 are located in a plane. By turning the annular nozzle 1, the nozzle bores 8 are alternately moved in the area of the chamber opening 10. The chamber opening has the design of a slot and extends in a radial direction over a long guide area of the nozzle bore 8. As a result, the length of the chamber opening 10 determines an opening period of the nozzle bore 8, while the nozzle bore is coupled with the pressure chamber 9 via the chamber opening 10 and generates a pressure impulse in the guiding groove 7.

The stator 2 is retained on a carrier 3 and comprises a bearing bore 18 concentrically to the guiding collar 12. Inside the bearing bore 18 the drive shaft 6 is located and can be rotatably supported by means of the bearing 23.

The drive shaft 6 is coupled with a motor 19 such as an electric motor by means of which the annular nozzle 1 can be powered with predetermined circumferential speed.

In the area of the chamber opening 10 on the circumference of the guiding collar 12 a cover 13 for the annular nozzle 1 has been arranged on the opposite side.

FIG. 1 shows that the cover 13 is flexibly connected to the carrier 3. In this embodiment, the cover 13 is designed to be pivoted above a swivel axis 14 relative to the annular nozzle 1. However, it is also possible to arrange the cover 13 in a rigid manner.

FIG. 2 shows that the cover 13 extends over the area of chamber opening 10 in a radial direction on the circumference of the annular nozzle 1. In this area, a thread 20 is guided in the guiding groove 7 on the circumference of the annular nozzle 1. For this purpose, the annular nozzle 1 is provided on an inlet side 21 with an inlet thread guide 15 and on an outlet side 22 with an outlet thread guide 16. Consequently, it is possible to guide the thread 20 between the inlet thread guide 15 and the outlet thread guide 16 with a partial wrapping on the annular nozzle 1. In this embodiment, the inlet thread guide 15 and the outlet thread guide 16 are formed by tension pins or, alternatively, by guide rollers.

In the embodiment shown in FIGS. 1 and 2, compressed air is supplied to the pressure chamber 9 of the stator 2 in order to produce interweaving knots in a multi-filament thread 20. The annular nozzle 1, which guides the thread 20 in the guiding groove 7, generates within specific time intervals pressure impulses as soon as one of the nozzle bores 8 reaches the area of the chamber opening 10. In the process, the pressure impulse causes a local swirling on the multi-filament thread 20, thus forming interweaving knots on the thread.

To be able to produce consistent and strongly developed interweaving knots, the thread 20 is guided with a contact wrap angle in the base of the guiding groove 7. At the same time, the inlet thread guide 15 and the outlet thread guide 16 are arranged in such a way that the contact wrap angle of the thread in the guiding groove of the annular nozzle comprises a minimum wrap angle in relation to the chamber opening 10.

Figure 3:
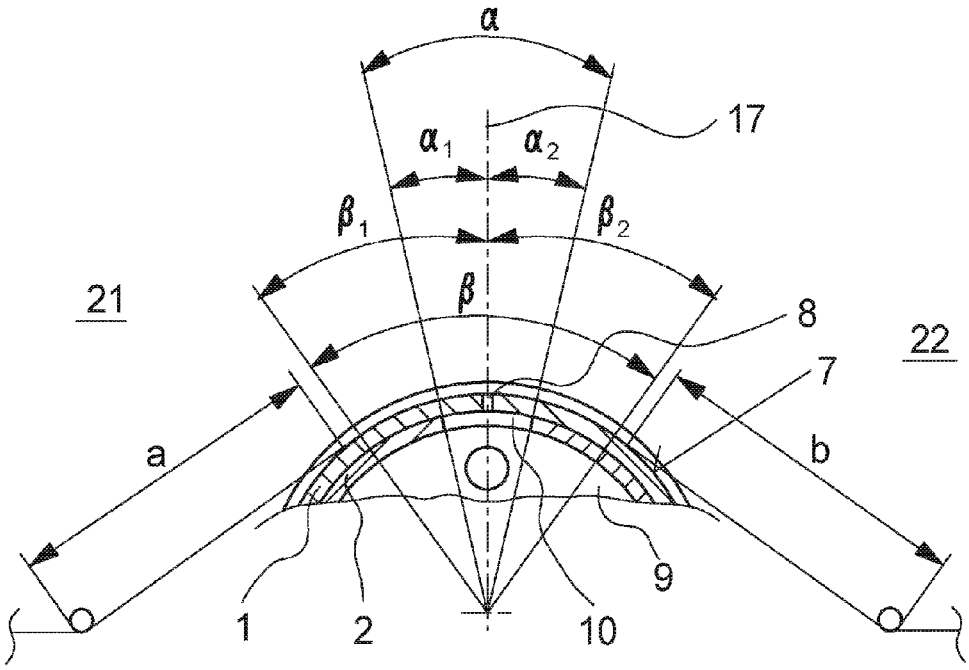
FIG. 3 is a simplified cross-sectional view of the embodiment shown in FIG. 1.

FIG. 3 shows a diagram of a cross-section of the embodiment shown in FIG. 1 and FIG. 2 with the geometric sizes and relations. Here, the inlet thread guide 15 and the outlet thread guide 16 are arranged mirror-symmetrically to the annular nozzle 1, thus forming a mirror-symmetrical axis 17 between the inlet thread guide 15 and the outlet thread guide 16. In this embodiment, the mirror-symmetrical axis 17 is identical with a center of the chamber opening 10 on the circumference of the stator 2. The chamber opening 10 extends on both sides of the mirror-symmetrical axis 17, thus forming an opening angle $\alpha$. Consequently, the mirror-symmetrical axis 17 is an angle bisector to the opening angle $\alpha$, so that the opening angle $\alpha$ on the inlet side 21 comprises the angular section $\alpha_1$ and on the outlet side the angular section $\alpha_2$. Therefore $\alpha=\alpha_1+\alpha_2$.

In this embodiment, the position of the inlet thread guide 15 and the outlet thread guide 16 is selected in such a way that several guiding sections form on the thread 20 between the two thread guides 15 and 16. A first guide section is characterized by an inlet section of the thread which is marked by the space between the inlet thread guide 15 and an accumulating point of the thread 20 on the circumference of the guiding groove 7 of the annular nozzle 1. The inlet section is marked with the lower case letter a.

Consequently, because of the mirror symmetry, on the outlet side 22, an outlet section is also formed by the guiding groove 7 of the annular nozzle 1 between the outlet thread guide 16 and an accumulating point of the thread 20. The outlet section of the thread is marked by the lower case letter b. In this embodiment, the inlet section a has the same length as the outlet section b.

However, in principle, it is also possible to generate differences in length between the inlet section and the outlet section by irregularly arranging the thread guides 15 and 16. The inlet section a and the outlet section b define a so-called clamping length in which the thread is fixed during air treatment.

However, for the formation of the interweaving knots, a third important guide section of the thread 20 proves to be of great importance, which guide section is determined by the contact length of the thread 20 in the base of the guiding groove 7 of the annular nozzle 1. The contact length of the thread 20 is defined by the contact wrap angle $\beta$. Because of the mirror symmetry, the mirror-symmetrical axis 17 also represents an angle bisector to the contact wrap angle $\beta$. In this respect, the annular nozzle 1 on the inlet side 21 comprises the angular section $\beta_1$ and on the outlet side 22 the angular section $\beta_2$. The total contact wrap angle $\beta$ results from the sum of the angular sections $\beta_1$ and $\beta_2$.

The representation in FIG. 3 shows that the contact wrap angle $\beta$ is greater than the opening angle $\alpha$ of the chamber opening 10 on the circumference of the stator 2. As a result, even before receiving a pressure impulse, the thread 20 is guided securely with contact on the base of the guiding groove 7 of the annular nozzle 1. This limits the flexibility of the thread 20 between the inlet thread guide 15 and the outlet thread guide 16, resulting in increased stability of the knots. It has been demonstrated that the contact wrap angle of the thread in the guiding groove 7 of the annular nozzle 1 should be designed in such a way that it is greater than the opening angle $\alpha$ of the chamber opening 10 on the stator 2 at least by a factor of 1.2, preferably at least by a factor of 1.5. Depending on the type of thread and the process, the contact wrap angle can be formed by the position of the inlet thread guide 15 and outlet thread guide 16 in the range of between 12° and 180°. Preferably, the chamber opening 10 on the stator 2 comprises an opening angle $\alpha$ in the range of between 10° and 40°. Opening angles greater than 40° result in relatively high compressed air consumption and relatively high compressed air losses without improving the number or development of interweaving knots.

Depending on the type of thread and the process, the inlet section a and the outlet section b are set in a range of between 2 cm and 15 cm, wherein there is a tendency that shorter sections are formed with threads of fine yarn counts and longer sections with threads of larger yarn counts.

To create short opening times, during which the nozzle bore 8 of the annular nozzle 1 is connected with the chamber opening 10 and the pressure chamber 9 on the stator 2, it is required for forming an intense pressure impulse that the pressurized air inside the nozzle bore 8 has to overcome the shortest possible distance so as to achieve relatively low compressed air losses. Therefore, the nozzle bore 8 in the annular nozzle 1 is preferably designed in such a way that the length of the nozzle bore 8 and the diameter of the nozzle bore 8 have a specific ratio. The length to diameter ratio in the range of between 0.5 and 5 proved to be especially advantageous for forming the pressure impulses. As a result, the annular nozzle 1 should be provided with the shortest possible nozzle bores 8.

Furthermore, when several nozzle bores 8 are distributed on the circumference of the annular nozzle 1, it is necessary to watch that an angular pitch occurring between the nozzle bores 8 is always greater than the opening angle $\alpha$ of the chamber opening 10. In this way, it can be guaranteed that the interweaving knots in each thread 20 result from a generated pressure impulse so as to avoid overlapping and irregularities.

Figure 4:
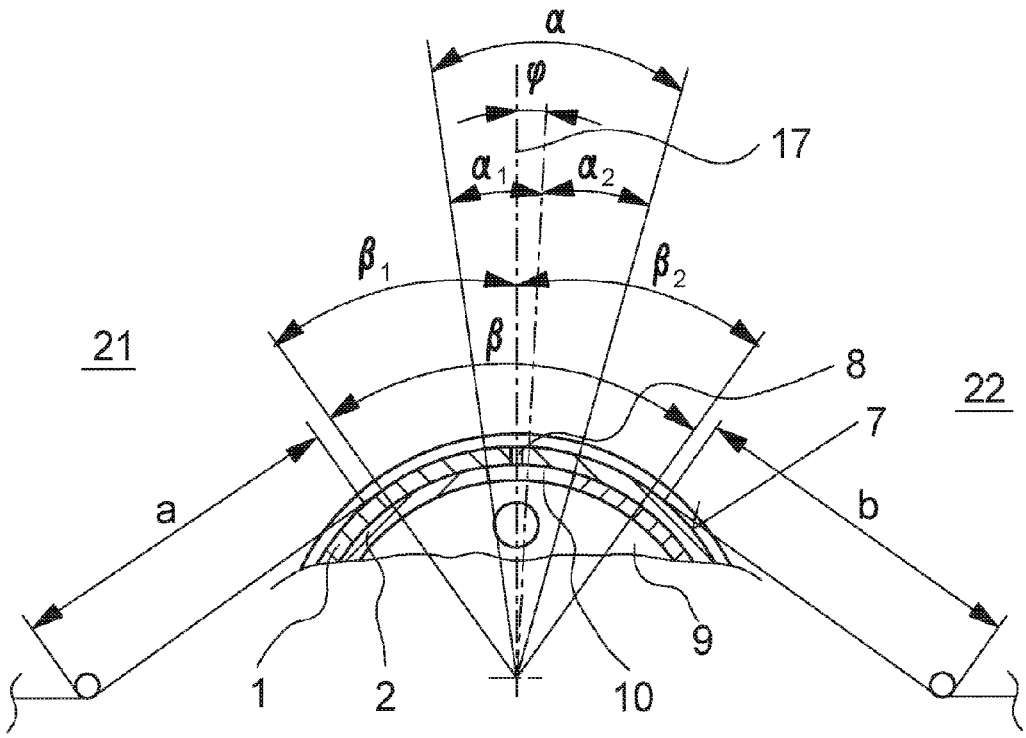
FIG. 4 is a simplified cross-sectional view of another embodiment of the device according to the present invention.

FIG. 4 shows an exemplary arrangement of the stator 2 in relation to the mirror-symmetrical axis 17. Basically, it is possible to design different contact lengths between the thread 20 and the annular nozzle 1 on the inlet side 21, as well as on the outlet side 22. FIG. 4 shows an embodiment in which the chamber opening 10 on the stator 2 is designed in such a way that it is offset to the mirror-symmetrical axis by a particular angle $\phi$. Consequently, compared to the embodiment shown in FIG. 3, with the same opening angles $\alpha$ and the same contact wrap angle $\beta$, there is a greater contact zone until the arrival of the pressure impulse on the inlet side 21. This allows for further exertion of influence in order to change the type and size of interweaving knots.

In the embodiment shown in FIGS. 1 and 2, the annular nozzle 1 can be powered by means of the electric motor. However, it is also possible that the annular nozzle 1 is designed without a power unit and is powered merely through the friction of the thread 20 guided with a partial wrapping.

However, it proved to be especially advantageous when a specific relative speed existed between the thread and the annular nozzle. In this respect, a method according to the present invention for producing interweaving knots is preferably performed with the device shown in FIGS. 1 and 2.

In the method of the present invention, the thread is usually guided between two godets, which determine a speed of the thread. By means of this thread speed, the thread 20 is guided on the circumference of the annular nozzle 1. To generate a thread tension that is advantageous for producing interweaving knots independent of the thread tension set between the godets, the annular nozzle 1 is powered with a circumferential speed that is lower than the speed of the thread 20, wherein the annular nozzle 1 and the thread 20 are guided in the same direction, as is shown in FIG. 2. This results in a slippage between the base of the guiding groove 7 and the thread 20, causing additional friction forces on the thread 20. This resulted in an improvement of the number, strength and regularity of the interweaving knots. For this, it proved to be advantageous to use the settings in which the circumferential speed of the annular nozzle 1 is smaller than the speed of the thread 20 by a factor in the range between 0.35 and 0.8. However, the slippage generated by the relative speed should have a minimum size so that higher circumferential speeds no longer showed any positive effect.

Figure 5:
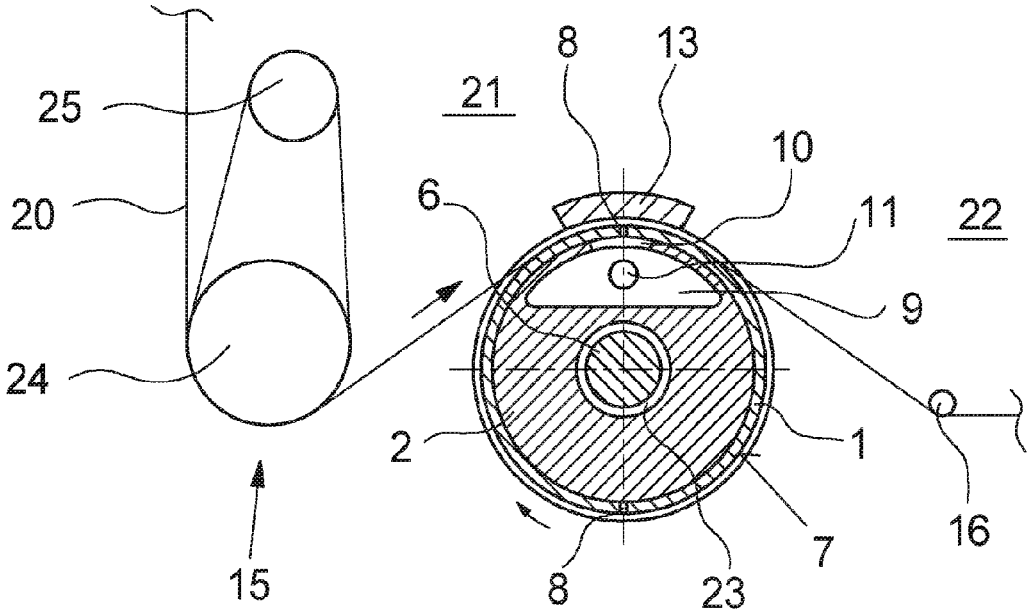
FIG. 5 is a cross-sectional view of a further embodiment of the device according to the present invention.

The method of the present invention can also be advantageously performed with the device shown in FIG. 5. FIG. 5 shows a cross-section view of one embodiment of the device. Basically, the embodiment is identical with the embodiment shown in FIGS. 1 and 2. Therefore, in order to avoid repetition we will only explain the differences here.

In the embodiment shown in FIG. 5, the inlet thread guide 15 is formed by a powered godet 24 on the inlet side 21. The godet 24 is supplied with an accompanying roller 25 to make it possible that a thread 20 can be guided with multiple wrapping, arriving directly in the guiding groove 7 of the annular nozzle 1 when running off the godet 24. The wrap angle of the thread 20 ensuing on the annular nozzle 1 is determined by the arrangement of the godet 24 and outlet thread guide 16 arranged on the outlet side 22.

In the embodiment shown in FIG. 5, it is possible to set in an advantageous manner a speed difference between the godet 24 and the annular nozzle 1, which can result in an increase of the thread tension or a relief of tension of the thread.

At this point, we would like to mention that in the embodiment shown in FIG. 5, the outlet thread guide 16 can also be formed by a godet. Such an arrangement has the advantage that the thread can be guided with particularly low friction.

REFERENCE LIST

1 annular nozzle
2 stator
3 carrier
4 end wall
5 hub
6 drive shaft
7 guiding groove
8 nozzle bore
9 pressure chamber
10 chamber opening
11 compressed air supply
12 guiding collar
13 cover
14 swivel axis
15 inlet thread guide
16 outlet thread guide
17 mirror-symmetrical axis
18 bearing bore
19 electric motor
20 thread
21 inlet side
22 outlet side
23 bearing
24 godet
25 accompanying roller

The invention claimed is:

1. A device for producing interweaving knots in a multifilament thread comprising:

a stationary stator that includes (i) a chamber opening on its circumference and (ii) a pressure chamber;

a rotating annular nozzle disposed about a circumference of the stator, the annular nozzle including a circumferential guiding groove and at least one nozzle bore that is at least intermittently in fluid communication with the chamber opening and the guiding groove;

a cover extending over the guiding groove; and an inlet thread guide and an outlet thread guide arranged on both sides of the annular nozzle wherein the thread is guided with contact in a base of the guiding groove of the annular nozzle, such that an opening angle ($\alpha$) of the chamber opening on the stator and a contact wrap angle ($\beta$) of the thread are overlapping in the guiding groove;

wherein the inlet thread guide and the outlet thread guide are arranged in such a way that the contact wrap angle ($\beta$) of the thread in the guiding groove of the annular nozzle is greater than the opening angle ($\alpha$) of the chamber opening on the stator.

2. The device according to claim 1, wherein the contact wrap angle ($\beta$) of the thread in the guiding groove of the annular nozzle is greater than the opening angle ($\alpha$) of the chamber opening on the stator by at least a factor of 1.2.

3. The device according to claim 1, wherein the contact wrap angle ($\beta$) of the thread in the guiding groove of the annular nozzle is greater than the opening angle (α) of the chamber opening on the stator by at least a factor of 1.5.

4. The device according to claim 1, wherein the inlet thread guide and the outlet thread guide are arranged mirror-symmetrically to the annular nozzle and wherein the chamber opening on the stator is arranged symmetrically to a mirror-symmetrical axis.

5. The device according to claim 1, wherein the inlet thread guide and the outlet thread guide are arranged mirror-symmetrically to the annular nozzle and wherein the chamber opening on the stator is arranged asymmetrically to a mirror-symmetrical axis.

6. The device according to claim 1, wherein the inlet thread guide and the outlet thread guide are configured so that the contact wrap angle (β) is between 12° and 180°.

7. The device according to claim 1, wherein the chamber opening on the stator is configured so that the opening angle (α) of the chamber opening is between 10° and 40°.

8. The device according to claim 1, further comprising a non-contact inlet section (a) defined by the space between the inlet thread guide and the annular nozzle, wherein a length of the inlet section (a) is between about 2 cm and about 15 cm.

9. The device according to claim 1, further comprising a non-contact outlet section (b) defined by the space between the annular nozzle and the outlet thread guide, wherein a length of the outlet section (b) is between about 2 cm and about 15 cm.

10. The device according to claim 1 further comprising a plurality of nozzle bores provided at the annular nozzle, wherein an angular pitch formed between two adjacent nozzle bores is greater than the opening angle (α) of the chamber opening on the stator.

11. The device according to claim 1, wherein the nozzle bore of the annular nozzle has a length to diameter ratio in the range between 0.5 and 5.

12. The device according to claim 1, further comprising a motor drivingly coupled to the annular nozzle.

13. The device according to claim 1, wherein at least one of the inlet thread guide or the outlet thread guide comprises a powered godet.

14. The device according to claim 13, wherein a circumferential speed of the annular nozzle is smaller than a speed of the thread by a factor between about 0.35 and about 0.80.

15. A method for producing interweaving knots on a running thread by means of a device according to claim 1, comprising:

guiding a thread between two godets; and rotating the annular nozzle with a circumferential speed that is lower than a speed of the thread, wherein the annular nozzle and the thread are guided in the same direction.

* * * * *